US006180330B1

(12) United States Patent
Gula et al.

(10) Patent No.: US 6,180,330 B1
(45) Date of Patent: Jan. 30, 2001

(54) TINTING CORRECTION OF IMAGES IN THE PHOTOGRAPHIC IMAGE LAYERS

(75) Inventors: Thaddeus S. Gula, Rochester; Robert P. Bourdelais, Pittsford; John F. Sawyer, Fairport; Mary Christine Brick, Webster, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/370,951

(22) Filed: Aug. 10, 1999

(51) Int. Cl.[7] ..... G03C 1/825; G03C 1/83; G03C 1/79; B41J 2/01

(52) U.S. Cl. ..... 430/519; 430/510; 430/517; 430/521; 430/536; 430/538; 430/539; 347/105

(58) Field of Search ..... 430/536, 538, 430/539, 510, 517, 519, 521; 347/105

(56) References Cited

U.S. PATENT DOCUMENTS

| | | | | |
|---|---|---|---|---|
| 4,558,002 | * | 12/1985 | Aotsuka et al. | 430/536 |
| 4,563,406 | * | 1/1986 | Ohbayashi et al. | 430/513 |
| 4,755,454 | * | 7/1988 | Aotsuka et al. | 430/536 |
| 5,091,294 | | 2/1992 | Nishijima et al. | 430/551 |
| 5,234,804 | * | 8/1993 | Sato et al. | 430/536 |
| 5,252,424 | * | 10/1993 | Sato et al. | 430/538 |
| 5,368,996 | * | 11/1994 | Asami | 430/536 |
| 5,459,014 | | 10/1995 | Nishijima et al. | 430/551 |
| 5,460,931 | * | 10/1995 | Tanaka et al. | 430/536 |
| 5,966,282 | | 2/1999 | Bourdelais et al. | 430/536 |
| 6,001,547 | * | 12/1999 | Gula et al. | 430/536 |

FOREIGN PATENT DOCUMENTS 6-167768 6/1994 (JP) .

OTHER PUBLICATIONS

Japanese Abstract 6–167768, Jun. 14, 1994.

* cited by examiner

*Primary Examiner*—Richard L. Schilling
(74) *Attorney, Agent, or Firm*—Paul A. Leipold

(57) ABSTRACT

An imaging element comprising a reflective base and at least one gelatin containing layer said at least one layer comprising a dispersion of solid particle pigments of a particle size less than 1.0 micrometer.

40 Claims, No Drawings

TINTING CORRECTION OF IMAGES IN THE PHOTOGRAPHIC IMAGE LAYERS

FIELD OF THE INVENTION

This invention relates to high quality imaging materials. In a preferred form it relates to materials for photographic color papers and other imaging materials manufactured by using high temperature extruded layers.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult and requires great care and expense to ensure proper laydown and cooling of the polyethylene layers.

In photographic papers the polyethylene layer also serves as a carrier layer for titanium dioxide and other whiting materials as well as tinting materials. By experience, it has been shown that a bluish tint is necessary as the background for images on paper type bases to obtain a favorable response from customers of these products. It would be desirable if the colorant materials rather than being dispersed throughout the polyethylene layer could be included in a layer of the photographic materials that is not subjected to the rigors of high temperature extrusion, which is the most common way of manufacturing the melt extruded polyethylene layer.

The high temperature processing of the polyethylene layer requires tint materials that are expensive because they must be chemically and color stable at temperatures typically over 290 degrees centigrade. It is common to incur clumping of the whitener and tint materials and it may be necessary to resort to special high temperature filtration to minimize objectionable clumping which is seen as undesirable spots in the image.

The compounding of the polyethylene, whiteners, and tinting agents is usually done far in advance of the extrusion of the layer on the base therefore, it is impossible to change the tint significantly if tint changes are needed to accommodate any colorimetric variations of the base materials or subsequent image forming layers.

It has been proposed in U.S. Pat. No. 5,866,282—Bourdelais et al., to utilize a composite support material with laminated biaxially oriented polyolefin sheets as a photographic imaging material. In U.S. Pat. No. 5,866,282, biaxially oriented polyolefin sheets are extrusion laminated to cellulose paper to create a support for silver halide imaging layers.

In European Application EP 585 679 A1, anthraquinone dyes are incorporated into emulsion interlayers as conventional oil and water dispersions. The anthraquinone dye dispersions used both ethyl acetate and a high boiling permanent solvent to dissolve the organic compounds prior to incorporation into the photographic emulsion coated on a support consisting of a high density polyethylene coated on a base paper. Incorporating oil and water dispersion pigments as disclosed in EP 585 679 A1 is undesirable because pigments, by nature, are insoluble, crystalline solids, which are the most thermodynamically stable form that they can assume. In an oil and water dispersion, they would be in the form of an amorphous solid, which is thermodynamically unstable. Therefore, one would have to worry about the pigment eventually converting to the crystalline form with age. A further problem with the use of ethyl acetate and a high boiling point solvent is that the high boiling solvent is not removed with evaporation, and it will cause unwanted interactions in the coating melt such as ripening of Ostwald oxidized developer scavenger of dispersion particles, or other components in the other imaging layers. It would be desirable if pigments could be incorporated into the imaging layers without the use of ethyl acetate and high boiling point permanent solvents.

PROBLEM TO BE SOLVED BY THE INVENTION

There is a need for improved methods of providing a generally blue tint to substrates comprising the base of the imaging element without clumping of pigments and at lower cost and with more flexibility to accommodate colorimetric variations of the base materials or subsequent image forming layers. Further, there is a need to avoid the need for high boiling point solvents for the incorporation of pigments into the imaging layers.

SUMMARY OF THE INVENTION

It is an object of the invention to provide improved tinting of imaging materials.

It is another object to provide lower cost tints in imaging materials.

It is a further object to provide the use of stable pigments in imaging materials which can be used at lower temperatures during the assembly process.

It is an additional object to provide better dispersion of tinting materials in imaging elements.

These and other objects of the invention are generally accomplished by an imaging element comprising a reflective base and at least one gelatin containing layer, said at least one layer comprising a dispersion of solid particle pigments of a particle size less than 1.0 micrometer.

ADVANTAGEOUS EFFECT OF THE INVENTION

The invention provides lower cost tinting of color imaging materials. It further provides greater flexibility in tinting of imaging materials and greater selection of pigments for tinting of imaging materials.

DETAILED DESCRIPTION OF THE INVENTION

The invention has numerous advantages over prior methods of tinting of imaging materials. The invention provides the ability to use lower cost and lower amounts of pigments as they are applied in low temperature gelatin systems. Further, the invention provides the ability to easily change tint levels during manufacturing as tinting is carried out as the element is laid down and is not fixed by the choice of substrate. In conventional color photographic paper the tints are added into the waterproofing polyethylene layers on the base paper. These tints are generally mixed into the polyethylene long before coating, and their color may change prior to coating being carried out. The tints are added by the manufacture of the polyethylene and arrive in pelletized form. It is difficult to determine what tint a layer formed with these pellets will have without actually coating the pellets onto paper. It would be desirable if tint could be adjusted during manufacturing rather than relying on polymer supplies to be consistent. In the instant invention colorant is not added to the imaging element until the moment of emulsion coating and, therefore, the colorant will not change prior to laydown. The prior colorants utilized in tinting base materials had a tendency to clump during coating. This clumping led to irregularities in image quality in photographic elements. The filtering of polyethylene polymers to remove clumping has been attempted. However, such filtering is expensive and not completely successful as clumping still takes place and is present in the laydown material. The pigments coated from gelatin layers are much less susceptible to clumping resulting in a more uniform photographic element. The pigments of the invention are an aqueous solid particle dispersion added directly to the imaging layer or layers. The aqueous dispersion of solid particle pigments overcomes the problems associated with a high boiling point solvent and avoids the problem of the pigment eventually converting to the crystalline form with age. These and other advantages will be apparent from the detailed description below.

Table 1 is the typical assembly of a photographic print with the following details:

A. A multilayered gelatin formulation with many distinct layers which will be exposed to light and developed to provide a color image only in the areas that are needed to imitate the image as photographed C. A typical waterproof monolayer of polyethylene with additives for color tint adjustment and whiteness D. A comparatively thick layer of paper fiber to provide the necessary product thickness, opacity, and stiffness E. A typical waterproof monolayer of clear polyethylene with an outside surface roughness sufficient to reflect light to give a dull appearance.

Table 1A shows the addition of layer B. which is an additional layer of gelatin that contains tinting or colorant materials that are applied generally at the same time as layer A. In this case, layer C. is modified by removing the tinting materials.

In other designs, layer B. could be incorporated as another layer in between the layers of A in FIG. 1 or tinting materials could be incorporated in existing layers of A in Table 1.

TABLE 1

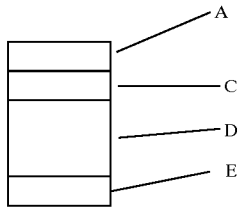

TABLE 1A

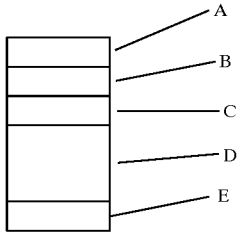

For the imaging element of this invention, the imaging layers are color corrected to provide a perceptually preferred density minimum. Typically imaging layers that contain gelatin have a inherent or native color that needs correction to obtain a preferred density minimum. For high quality images, a slight blue tint is preferred. Prior art imaging supports have typically incorporated blue tints into the support prior to the coating of the imaging layers. The elements of this invention incorporate tint materials into the imaging layers to correct the native yellowness of the imaging formulation. For example, in prior art photographic papers, the blue tint material is dispersed into the melt extruded polyethylene layer coated on cellulose paper. The blue tint is added to the polyethylene to correct for the native yellowness of the gelatin used as a carrier of the silver halide imaging layers. Without the tint materials, the density minimum of a photograph would be an undesirable yellow. In the case of a photographic element, blue pigments may be added into one of the silver halide imaging layers to correct for the native yellowness of the gelatin. For a photographic element, it has been found that the addition of the blue tint to the silver halide imaging layers resulted in a 75% reduction in blue tint usage compared to tinting the polyethylene layers.

A unique feature of this invention is the particle size of the pigments used to tint the imaging layers. The pigments are preferable milled into a particle size less than 1.0 micrometers to improve the dispersion quality and to improve the light absorption characteristics of the pigments. Surprisingly, it has been found that when the pigments used in this invention were milled to less than 0.1 micrometers, the unwanted light absorption of the pigments were reduced producing pigments that were more efficient. Because the milled pigments are less than 1.0 micrometer in size, the use of an aqueous dispersion is possible avoiding the need for a high boiling point solvents to incorporate the pigments into the gelatin. The aqueous solid particle dispersions also allow for increased concentrations of pigments to be used to overcome the native yellowness of the gelatin layers and to provide consumers with the perceptually preferred blue tint to the density minimum areas of an image. By utilizing aqueous solid particle dispersions pigments, pigment concentrations in the gelatin layer are greater than 0.01 $mg/m^2$. Pigments concentrations above 0.006 $mg/m^2$ are preferred because concentrations above 0.006 $mg/m^2$ are required to offset the native yellowness of silver halide and ink jet receiving layers:

Since the invention color corrects for the native color of the imaging layers, the imaging elements may be coated on any suitable imaging base materials. Such base materials are well known in the art and include, polyolefin extrusion coated cellulose paper, polyester, voided polyester, biaxially oriented polyolefin sheets laminated to cellulose paper, polyolefin sheets laminated to polyester, polyolefin sheets laminated to voided polyester, clay coated paper and oriented polyolefin sheets. Polyolefin sheets applicable for use in the present invention are described in U.S. Pat. Nos. 5,874,205; 5,853,965 and 5,866,282. Microvoided polyethylene terephalate supports applicable for use in the present invention are described in U.S. Pat. Nos. 4,912,333; 4,994,312 and 5,055,371.

As used herein the phrase "imaging element" is a material that may be used as a laminated support for the transfer of images to the support by techniques such as ink jet printing or thermal dye transfer as well as a support for silver halide images. As used herein, the phrase "photographic element" is a material that utilizes photosensitive silver halide in the formation of images. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The thermal dye image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof. The dye image-rcceiving layer may be present in any amount which is effective for the intended purpose. In general, good results have been obtained at a concentration of from about 1 to about 10 $g/m^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228.

As noted above, dye-donor elements are used to form a dye transfer image. Such a process comprises image-wise-heating a dye-donor element and transferring a dye image to a dye-receiving element as described above to form the dye transfer image.

In a preferred embodiment of the thermal dye transfer method of printing, a dye donor element is employed which compromises a poly-(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in detail in many books and publications. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photorecptors.

In one form of the electrophotographic process the copier uses imagewise photodischarge, through analog or digital exposure, of a uniformly charged photoconductor. The photoconductor may be a single-use system, or it may be rechargeable and reimageable, like those based on selenium or organic photoreceptors.

In one form of the electrophotographic process, a photosensitive element is permanently imaged to form areas of differential conductivity. Uniform electrostatic charging, followed by differential discharge of the imaged element, creates an electrostatic image. These elements are called electrographic or xeroprinting masters because they can be repeatedly charged and developed after a single imaging exposure.

In an alternate electrographic process, electrostatic images are created iono-graphically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon vaporation of the solvent these toners form a film bonded to the paper. For heat-fusible toners, thermoplastic polymers are used as part of the particle. Heating both removes residual liquid and fixes the toner to paper.

The dye receiving layer (DRL) for ink jet imaging may be applied by any known methods. Such as solvent coating, or melt extrusion coating techniques. The DRL is coated over a tie layer (TL) at a thickness ranging from 0.1–10 micrometers, preferably 0.5–5 micrometers. There are many known formulations which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al., in U.S. Pat. Nos. 4,879,166, 5,14,730, 5,264,275, 5,104,730, 4,879,166, and Japanese Patent Nos. 1,095,091, 2,276,671, 2,276,670, 4,267,180, 5,024,335, 5,016,517, discloses aqueous based DRL formulations comprising mixtures of psuedo-bohemite and certain water soluble resins. Light, in U.S. Pat. Nos. 4,903,040, 4,930,041, 5,084,338, 5,126,194, 5,126,195, 5,139,8667, and 5,147,717, discloses aqueous-based DRL formulations comprising mixtures of vinyl pyrrolidone polymers and certain water-dispersible and/or water-soluble polyesters, along with other polymers and addenda. Butters, et al., in U.S. Pat. Nos. 4,857,386, and 5,102,717, disclose ink-absorbent resin layers comprising mixtures of vinyl pyrrolidone polymers and acrylic or methacrylic polymers. Sato, et al., in U.S. Pat. No. 5,194,317, and Higuma, et all., in U.S. Pat. No. 5,059,983, disclose aqueous-coatable DRL formulations based on poly (vinyl alcohol). Iqbal, in U.S. Pat. No. 5,208,092, discloses water-based IRL formulations comprising vinyl copolymers which are subsequently cross-linked. In addition to these examples, there may be other known or contemplated DRL formulations which are consistent with the aforementioned primary and secondary requirements of the DRL, all of which fall under the spirit and scope of the current invention.

The preferred DRL is a 0.1–10 $\mu$m DRL which is coated as an aqueous dispersion of 5 parts alumoxane and 5 parts poly (vinyl pyrrolidone). The DRL may also contain varying levels and sizes of matting agents for the purpose of controlling gloss, friction, and/or finger print resistance, surfactants to enhance surface uniformity and to adjust the surface tension of the dried coating, mordanting agents, antioxidants, UV absorbing compounds, light stabilizers, and the like.

Although the ink-receiving elements as described above can be successfully used to achieve the objectives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118, 5,027,131, and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560° C. printer. However, it is intended that alternative embodiments of the image-recording elements as described above, which may be formulated for use with inks which are specific to a given ink-recording process or to a given commercial vendor, fall within the scope of the present invention.

Printing generally accomplished by Flexographic or Rotogravure. Flexography is an offset letterpress technique where the printing plates are made from rubber or photopolymers. The printing is accomplished by the transfer of the ink from the raised surface of the printing plate to the support of this invention. The Rotogravure method of printing uses a print cylinder with thousands of tiny cells which are below the surface of the printing cylinder. The ink is transferred from the cells when the print cylinder is brought into contact with the web at the impression roll.

Suitable inks for this invention include solvent based inks, water based inks and radiation cured inks. Examples of solvent based inks include nitrocellulose maleic, nitrocellulose polyamide, nitrocellulose acrylic, nitrocellulose urethane, chlorinated rubber, vinyl, acrylic, alcohol soluble acrylic, cellulose acetate acrylic styrene and other synthetic polymers. Examples of water based inks include acrylic emulsion, maleic resin dispersion, styrene maleic anhydride resins, and other synthetic polymers. Examples of radiation cured inks include ultraviolet and electron beam cure inks.

When the support of this invention is printed with Flexographic or Rotogravure inks a ink adhesion coating may be required to allow for efficient printing of the support. The top layer of the biaxially oriented sheet may be coated with any materials known in the art to improve ink adhesion to biaxially oriented polyolefin sheets of this invention. Examples include acrylic coatings and polyvinyl alcohol coatings. Surface treatments to the biaxially oriented sheets of this invention may also be used to improve ink adhesion. Examples include corona and flame treatment.

The photographic emulsions useful for this invention are generally prepared by precipitating silver halide crystals in a colloidal matrix by conventional methods in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in The Theory of the Photographic Process, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing toforrn emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203. This invention can be used with photographic elements such as described in U.S. Ser. No. 09/327,160 pending and U.S. Ser. No. 09/328,723 pending filed Jun. 9, 1999.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 micrometers.

In the following Table, reference will be made to (1) *Research Disclosure*, December 1978, Item 17643, (2) *Research Disclosure*, December 1989, Item 308119, and (3) *Research Disclosure*, September 1994, Item 36544, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

TABLE 1

| Reference | Section | Subject Matter |
|---|---|---|
| 1 | I, II | Grain composition, |
| 2 | I, II, IX, X, XI, | morphology and preparation. |
| | XII, XIV, XV | Emulsion preparation |
| | I, II, III, IX | including hardeners, |

TABLE 1-continued

| Reference | Section | Subject Matter |
|---|---|---|
| 3 | A & B | coating aids, addenda, etc. |
| 1 | III, IV | Chemical sensitization and |
| 2 | III, IV | spectral sensitization/ |
| 3 | IV, V | desensitization |
| 1 | V | UV dyes, optical |
| 2 | V | brighteners, luminescent |
| 3 | VI | dyes |
| 1 | VI | Antifoggants and |
| 2 | VI | stabilizers |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The colorants can be incorporated into the imaging element by direct addition of the colorant to a coating melt by mixing the colorant with an aqueous medium containing gelatin (or other hydrophilic colloid) at a temperature of 40° C. or higher. The colorant can also be mixed with an aqueous solution of a water-soluble or water-dispersible surfactant or polymer, and passing the premix through a mill until the desired particle size is obtained. The mill can be any high energy device such as a colloid mill, high pressure homogenizer, ball mill or the like.

The preferred color of the pigment or pigment combinations is blue so that when incorporated into a gelatin layer, it offsets the native yellowness of the gelatin, yielding a neutral background for the image layers.

Suitable pigments used in this invention can be any inorganic or organic, colored materials which are practically insoluble in the medium in which they are incorporated. The preferred pigments are organic, and are those described in *Industrial Organic Pigments: Production, Properties, Applications* by W. Herbst and K. Hunger, 1993, Wiley Publishers. These include: Azo Pigments such as monoazo yellow and orange, disazo, naphthol, naphthol reds, azo lakes, benzimidazolone, disazo condensation, metal complex, isoindolinone and isoindoline, Polycyclic Pigments such as phthalocyanine, quinacridone, perylene, perinone, diketopyrrolo pyrrole and thioindigo, and Anthrquinone Pigments such as anthrapyrimidine, flavanthrone, pyranthrone, anthanthrone, dioxazine, triarylcarbodium and quinophthalone.

The most preferred pigments are the anthraquinones such as Pigment Blue 60, phthalocyanines such as Pigment Blue 15, 15:1, 15:3, 15:4 and 15:6, and quinacridones such as Pigment Red 122, as listed in *NPIRI Raw Materials Data Handbook, Vol. 4, Pigments*, 1983, National Printing Research Institute. These pigments have a dye hue sufficient to overcome the native yellowness of the gelatin imaging layer and are easily dispersed in a aqueous solution.

An aqueous dispersion of the pigments is preferred because the preferred pigments are insoluble in most, if not all, organic solvents, and therefore a high quality dispersion is not likely in a solvent system. In fact, the only solvent that will dissolve the most preferred pigments such as PR-122 and PB-15 is concentrated sulfuric acid, which is not an organic solvent. Preferred pigments of the invention are by nature, insoluble, crystalline solids, which is the most thermodynamically stable form that they can assume. In an oil and water dispersion, they would be in the form of an amorphous solid, which is thermodynamically unstable. Therefore, one would have to worry about the pigment eventually converting to the crystalline form with age. One might as well start with a crystalline solid and not worry about preventing the phase transition. Another reason to avoid solvent pigment dispersions is that the high boiling solvent is not removed with evaporation, and it could cause unwanted interactions in the coating melt such as Ostwald ripening of other dispersion particles in the coating melt or dispersions in other layers, if it was used in the coating. The use of solid particle dispersion avoids organic solvents altogether.

In the preferred embodiment, the colorant is dispersed in the binder in the form of a solid particle dispersion. Such dispersions are formed by first mixing the colorant with an aqueous solution containing a water-soluble or water-dispersible surfactant or polymer to form a coarse aqueous premix, and adding the premix to a mill. The amount of water-soluble or water-dispersible surfactant or polymer can vary over a wide range, but is generally in the range of 0.01% to 100% by weight of polymer, preferably about 0.3% to about 60%, and more preferably 0.5% to 50%, the percentages being by weight of polymer, based on the weight of the colorant useful in imaging.

The mill can be for example, a ball mill, media mill, attritor mill, vibratory mill or the like. The mill is charged with the appropriate milling media such as, for example, beads of silica, silicon nitride, sand, zirconium oxide, yttria-stabilized zirconium oxide, alumina, titanium, glass, polystyrene, etc. The bead sizes typically range from 0.05 to 3.0 mm in diameter, but smaller media can be used if desired. The premix is milled until the desired particle size range is reached.

1. The solid colorant particles are subjected to repeated collisions with the milling media, resulting in crystal fracture, deagglomeration, and consequent particle size reduction. The solid particle dispersions of the colorant should have a final average particle size of less than 1 micrometers, preferably less than 0.1 micrometers, and most preferably between 0.01 and 0.1 micrometers. Most preferably, the solid colorant particles are of sub-micrometer average size. Solid particle size between 0.01 and 0.1 micrometers provides the best pigment utilization and had a reduction in unwanted light absorption compared to pigments with a particle size greater than 1.2 micrometers.

The preferred gelatin to pigment ratio in any gelatin layer is between 500:1 to 10,000:1. This gelatin to pigment ratio is preferred as this range provides the necessary color correction to typical photographic imaging layers and typical ink jet dye receiving layers to provide a perceptually preferred neutral background in the image. The preferred coverage of pigment in the gelatin layer is between 0.01 $mg/m^2$ and 100 $mg/m^2$. Coverages less than 0.01 $mg/ft^2$ are not sufficient to provide proper correction of the color and coverages greater than 100 $mg/m^2$ yield a density minimum that has been found to be objectionable by consumers.

Surfactants, polymers, and other additional conventional addenda may also be used in the dispersing process described herein in accordance with prior art solid particle dispersing procedures. Such surfactants, polymers and other addenda are disclosed in U.S. Pat. Nos. 5,468,598, 5,300,394, 5,278,037, 4,006,025, 4,924,916, 4,294,917, 4,940,654, 4,950,586, 4,927,744, 5,279,931, 5,158,863, 5,135,844, 5,091,296, 5,089,380, 5,103,640, 4,990,431, 4,970,139, 5,256,527, 5,089,380, 5,103,640, 4,990,431, 4,970,139, 5,256,527, 5,015,564, 5,008,179, 4,957,857, and 2,870,012, British Patent specifications Nos. 1,570,362 and 1,131,179 referenced above, in the dispersing process of the colorants.

Additional surfactants or other water soluble polymers may be added after formation of the colorant dispersion, before or after subsequent addition of the colorant dispersion to an aqueous coating medium for coating onto an imaging element support. The aqueous medium preferably contains other compounds such as stabilizers and dispersants, for example, additional anionic, nonionic, zwitterionic, or cationic surfactants, and water soluble binders such as gelatin as is well known in the imaging art. The aqueous coating medium may further contain other dispersions or emulsions of compounds useful in imaging.

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The reflectance or transmittance curves for the choice of tint agent must be chosen to correct for the yellowing of the base paper and yellow-green of the subsequent gelatin based image containing layers. Also, the tinting agents must have adequate properties with respect to cost, colorfastness, permanency, purity, ability to be dispersed in water and gelatin, health risks, and good photographic activity (lack of reaction with the photographic chemicals existing in the image forming layers).

It is well known that photographic manufacturers have different aims for the DMIN color (minimum developed photographic color density) or the areas of the resulting image that are supposed to be pure white. A pure white is rarely desired and an off tint , generally blue, is required for good customer acceptance. This DMIN color is made up of all the inherent off white colors of the layers used to make the photographic imaging member. To correct the final DMIN we can use the new gelatin color correction layer for adjustment as needed.

The following examples illustrate the practice of this invention. They are not intended to be exhaustive of all possible variations of the invention. Parts and percentages are by weight unless otherwise indicated.

EXAMPLE

In this example three blue pigments and one red pigment were milled and dispersed in a gel binder in the form of a aqueous solid particle dispersion. The blue and red solid particle dispersions were coated on a support consisting of cellulose paper laminated with biaxially oriented polyolefin sheets. This example will show that the addition of blue and red pigments coated in a gelatin layer can offset the native yellowness of a silver halide emulsion imaging layer and provide a perceptually preferred blue tint to the support without the need to tint the photographic support.

Photographic grade cellulose paper of this example:

A photographic grade cellulose paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26% anionic polyacrylamide, and 5.0% $TiO_2$ on a dry weight basis. An about 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 gm/cc. The paper base was then surface sized using a vertical size press with a 10% hydroxyethylated cornstarch solution to achieve a loading of 3.3 wt. % starch. The surface sized support was calendered to an apparent density of 1.04 gm/cc, and a thickness of 122 micrometers.

The following laminated photographic base was prepared by extrusion laminating the following top and bottom biaxially oriented sheets to both sides of a photographic grade cellulose paper support.

Top sheet:

OPPalyte 350 TW (Mobil Chemical Co.)

A composite sheet (38 micrometers thick) (d=0.75 g/cc) consisting of a microvoided and oriented polypropylene core (approximately 73% of the total sheet thickness), with a titanium dioxide pigmented system non-microvoided oriented polypropylene layer on the one side and a clear non-microvoided oriented polypropylene layer side; the void initiating material is poly(butylene terephthalate). The emulsion was coated on the skin layer containing $TiO_2$.

Bottom sheet:

BICOR 70 MLT (Mobil Chemical Co.)

BICOR 70 MLT (Mobil Chemical Co.), a one-side matte finish, one-side treated biaxially oriented polypropylene sheet (18 micrometers thick) (d=0.90 g/cc) consisting of a solid oriented polypropylene layer and a skin layer of a block copolymer of polyethylene and a terpolymer comprising ethylene, propylene and butylene. The skin layer was on the bottom and the solid polypropylene layer was laminated to the paper.

Both the above top and bottom sheets were extrusion laminated to a photographic grade cellulose paper support with a clear extrusion grade low density polyethylene at a coverage of 25 $g/m^2$ to create the biaxially oriented support of this example.

The following samples (6J340401–6J340424) in Table 2 were made by coating combination of the three blue pigments dispersions and the one red pigment dispersion. The OPPalyte 350 TW side of the of the laminated photographic support described above was coated using a slide hopper and dried as is required for water based gelatin systems. The pigments dispersions were coated in a single layer of ossein gelatin coated at a dry coverage of 1615 mg per square meter. The blue and red dispersions were made as follows:

A dispersion of colorant Pigment Blue-60 was made by combining 50.4 g Paliogen Blue L-6385 (BASF Corp.), 20.2 g Surfynol CT-171 (ICI Americas Inc.) surfactant, 430.2 g of deionized water, and 700.6 g of 50-micrometer polystyrene beads in a mill. The mixture was stirred with a 60 mm cowles-blade impeller at a speed of 5740 rev/min for 12 hours. After milling, 217.2 g of deionized water and 1.2 g Kathon biocide solution was added to the dispersion. The final dispersion contained 5.6% colorant by weight, with an average particle size of 0.066 micrometers.

A dispersion of colorant Ultramarine Blue Pigment Blue-29 was prepared by combining 15.0 g Ultramarine Blue UMB-293 (Cleveland Pigment and Color Co.), 3.0 g of Surfynol CT-171 (ICI Americas Inc.) surfactant, 82.0 g deionized water, and 250 ml of 1.8 mm zirconium oxide beads in a 16 oz. glass jar. The jar was rolled at a speed of 97 rev/min for 3 days. After milling, the final dispersion was combined with water and deionized gelatin. The final dispersion contained 5% colorant and 7% gelatin by weight. Examination of the dispersion by optical microscopy showed all particles to be less than 1 micrometer.

A dispersion of colorant Pigment Blue 15:6 was prepared by combining 5.0 g Heliogen Blue L6700F (BASF Corp.), 4.0 g of a 10% aqueous Luviskol K30 solution (BASF Corp.) surfactant, 1.0 g of a 10% aqueous sodium dodecyl sulfate solution, 40.0 g deionized water, and 125 ml of 1.8 mm zirconium oxide beads in an 8 oz. glass jar. The jar was placed on a SWECO vibratory mill for 3 days. After milling, the final dispersion was combined with water and deionized gelatin. The final dispersion contained 5% colorant and 7% gelatin by weight. Examination of the dispersion by optical microscopy showed all particles to be less than 1 $\mu$m.

A dispersion of colorant Pigment Red 122 was made by combining 2.4 g Sunfast Magenta 228–0013 (Sun Chemical Corp.), 1.9 g of a 10% aqueous Luviskol K30 solution (BASF Corp.) surfactant, 0.5 g of a 10% aqueous sodium dodecyl sulfate solution, 19.2 g deionized water, and 60 ml of 1.8 mm zirconium oxide beads in an 120 ml glass jar. The jar was placed on a SWECO vibratory mill for 3 days. After milling, the final dispersion was combined with water and deionized gelatin. The final dispersion contained 5% colorant and 7% gelatin by weight. Examination of the dispersion by optical microscopy showed all particles to be less than 1 micrometer.

TABLE 2

| Sample | PB60 (mg/m$^2$) | PB29 (mg/m$^2$) | PB15:6 (mg/m$^2$) | PR122 (mg/m$^2$) |
|---|---|---|---|---|
| 6J340401 | 0 | 0 | 0 | 0 |
| 6J340402 | 0.452 | 0 | 0 | 0 |
| 6J340403 | 1.345 | 0 | 0 | 0 |
| 6J340404 | 5.38 | 0 | 0 | 0 |
| 6J340405 | 0 | 64.6 | 0 | 0.646 |
| 6J340406 | 0 | 36.6 | 0 | 0.646 |
| 6J340407 | 0 | 46.3 | 0 | 1.21 |
| 6J340408 | 0 | 64.6 | 0 | 1.49 |
| 6J340409 | 0 | 82.9 | 0 | 1.21 |
| 6J340410 | 0 | 8.6 | 0 | 0.646 |
| 6J340411 | 0 | 82.9 | 0 | 0.086 |
| 6J340412 | 0 | 64.6 | 0 | 0 |
| 6J340413 | 0 | 46.3 | 0 | 0.086 |
| 6J340416 | 0 | 82.9 | 0 | 1.21 |
| 6J340422 | 0 | 82.9 | 0 | 0.086 |
| 6J340423 | 0 | 0 | 0.452 | 0 |
| 6J340424 | 0 | 0 | 1.345 | 0 |
| 6J340425 | 0 | 0 | 5.38 | 0 |

The samples made above were measured for the amount of color showing from the surface coated with Coating Format 1; the results are shown in Table 3. The measurements were made on a HUNTER spectrophotometer, CIE system, using procedure D65 to obtain ASTAR UVO (green -red axis, ultraviolet filter out) and BSTAR UVO (blue-yellow axis, ultraviolet filter out) ratings.

Colorimetric data were obtained with the following result, where the data are shown for the difference between the first sample (uncolored) and each successive sample.

To be most useful, the ASTAR UVO and BSTAR UVO corrections of up to minus 7.0 (red and blue directions) may be necessary depending on the product requirements. The samples show that it is possible to obtain corrections in those amounts. The choices of PB60, PB29, PB 15, and PR122 were found to provide all the requirements for cost, colorfastness, permanency, purity, ability to be dispersed in water and gelatin, health risks, and good photographic activity (lack of reaction with the photographic chemicals existing in the image forming layers).

TABLE 3

| Sample | ASTAR UVO Difference | BSTAR UVO Difference |
|---|---|---|
| 6J340401 | 0 | 0 |
| 6J340402 | −0.26 | −1.1 |
| 6J340403 | −0.81 | −2.76 |
| 6J340404 | −2.23 | −9.1 |
| 6J340405 | −0.36 | −1.78 |
| 6J340406 | 0.1 | −0.42 |
| 6J340407 | 0.51 | −0.01 |
| 6J340408 | 0.95 | −2.22 |
| 6J340409 | −0.07 | −4.38 |
| 6J340410 | −1.23 | −3.85 |
| 6J340411 | −1.5 | −4.25 |
| 6J340412 | −1.54 | −2.74 |
| 6J340413 | −0.39 | −2.66 |
| 6J340416 | −0.34 | −3.3 |
| 6J340422 | −1.99 | −2.56 |
| 6J340423 | −0.69 | −0.94 |
| 6J340424 | −1.8 | −2.79 |
| 6J340425 | −5.54 | −9.11 |

In summary, the tinting of the photographic gelatin layer has been shown to be effective and provide a superior method for the color correction of the native yellowness of the gelatin used in the silver halide imaging layer. Further, many of the problems associated with the color correction in the support material have been avoided. The imaging element of this invention is lower in cost than prior art methods of tinting the support materials. Pigments coated in a photographic gelatin layer of this example were reduced by 75% compared to the prior art methods of tinting the base materials. Finally, the problems associated with a solvent dispersion of a pigment were avoided by using a milled aqueous pigment dispersion.

The invention has been described in detail with particular reference to certain preferred embodiments thereof, but it will be understood that variations and modifications can be effected within the spirit and scope of the invention.

What is claimed is:

1. An imaging element comprising a reflective base and at least one gelatin containing layer said at least one layer comprising a dispersion of solid particle pigments of a particle size less than 0.1 micrometer.

2. The imaging element of claim 1 wherein said pigment is selected from the group consisting of Azo Pigments, Polycyclic Pigments, and Anthrquinone Pigments.

3. The imaging element of claim 1 wherein said pigments are selected from the group consisting of copper phthalocyanines, quinacridones, and anthraquinones.

4. The element of claim 1 wherein the pigment particles are solvent free.

5. The element of claim 1 wherein the ratio of gel to pigment in said at least one layer is between 500:1 to 10,000:1.

6. The imaging element of claim 1 wherein said pigment has a blue color.

7. The imaging element of claim 1 wherein said element comprises a photographic color paper.

8. The imaging element of claim 1 wherein said dispersion of solid particle pigments is in a layer not containing silver halide.

9. The imaging element of claim 1 wherein said dispersion of solid particle pigments is above the bottommost layer containing silver halide.

10. The imaging element of claim 1 wherein said reflective base has a white color.

11. The imaging element of claim 1 wherein said reflective base comprises at least one biaxially oriented film.

12. The imaging element of claim 1 wherein said reflective base comprises polyethylene loaded with titanium dioxide.

13. The imaging element of claim 1 wherein said reflective base comprises a base paper and two or more waterproof resin layers laminated on one surface of the base paper at the side to be coated with photosensitive emulsion wherein at least one of said waterproof resin layers comprises a white pigment.

14. The imaging element of claim 1 wherein said reflective base comprises a base paper laminated on the top and bottom sides with biaxially oriented polymer sheets.

15. The imaging element of claim 1 wherein said element comprises ink jet printing receiver material.

16. The imaging element of claim 1 wherein said pigment is present an amount 0.01 to 100 mg/m$^2$.

17. A method of forming a reflective imaging element comprising providing a milled pigment, forming an aqueous dispersion of solid particle pigment of a particle size less than 0.1 micrometer, providing a reflective support material and coating the said aqueous dispersion in at least one gelatin containing layer on top of said reflective support.

18. The method of claim 17 wherein said pigment has a particle size of between 0.1 and 0.01 $\mu$m.

19. The method of claim 17 wherein said pigment is selected from the group consisting of monoazo yellow, monoazo orange, diazo, naphthol reds, azo lakes, benzimidazolone, disazo condensation, phthalocyanine, quinacridone, perylene, perinone, diketopyrrolo pyrrole and thioindigo, anthrapyrimidine, flavanthrone, pyranthrone, anthanthrone, dioxazine, triarylcarbodium, and quinophthalone.

20. The method of claim 17 wherein said pigments are selected from the group consisting of copper phthalocyanines, quinacridones, and anthraquinones.

21. The method of claim 17 wherein said pigment has a blue color.

22. The method of claim 17 wherein said element comprises a photographic color paper.

23. The method of claim 17 wherein said dispersion of solid particle pigment is in a layer not containing silver halide.

24. The method of claim 17 wherein said dispersion of solid particle pigment is above the bottommost layer containing silver halide.

25. The method of claim 17 wherein said reflective base comprises at least one biaxially oriented film.

26. The method of claim 17 wherein said reflective base comprises polyethylene loaded with titanium dioxide.

27. The method of claim 17 wherein said reflective base comprises a base paper and two or more waterproof resin layers laminated on one surface of the base paper at the side to be coated with photosensitive emulsion wherein at least one of said waterproof resin layers comprises a white pigment.

28. The method of claim 17 wherein said reflective base comprises a base paper laminated on the top and bottom sides with biaxially oriented polymer sheets.

29. The method of claim 17 wherein the ratio of gel to pigment in said at least one layer is between 500:1 to 10,000:1.

30. An imaging element comprising a reflective base and at least one gelatin containing layer said at least one layer comprising a dispersion of solid particle pigments of a particle size of between 0.1 and 0.01 $\mu$m.

31. The imaging element of claim 30 wherein said pigments are selected from the group consisting of copper phthalocyanines, quinacridones, and anthraquinones.

32. The imaging element of claim 30 wherein said pigment has a blue color.

33. The imaging element of claim 30 wherein said element comprises a photographic color paper.

34. The imaging element of claim 33 wherein said reflective base comprises at least one biaxially oriented film.

35. The imaging element of claim 33 wherein said reflective base comprises polyethylene loaded with titanium dioxide.

36. The imaging element of claim 33 wherein said reflective base comprises a base paper and two or more waterproof resin layers laminated on one surface of the base paper at the side to be coated with photosensitive emulsion wherein at least one of said waterproof resin layers comprises a white pigment.

37. The imaging element of claim 33 wherein said reflective base comprises a base paper laminated on the top and bottom sides with biaxially oriented polymer sheets.

38. The imaging element of claim 32 wherein said element comprises ink jet printing receiver material.

39. The imaging element of claim 38 wherein said pigment is present in an amount 0.01 to 100 mg/m$^2$.

40. The element of claim 36 wherein the ratio of gel to pigment is said at least one layer is between 500:1 to 10,000:1.

* * * * *